US011772917B2

(12) United States Patent
Ito

(10) Patent No.: US 11,772,917 B2
(45) Date of Patent: Oct. 3, 2023

(54) SHEET CONVEYING DEVICE, IMAGE FORMING APPARATUS, AND SHEET PRESENCE OR ABSENCE DETERMINATION METHOD

(71) Applicant: TOSHIBA TEC KABUSHIKI KAISHA, Tokyo (JP)

(72) Inventor: Takeshi Ito, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 59 days.

(21) Appl. No.: 17/516,742

(22) Filed: Nov. 2, 2021

(65) Prior Publication Data

US 2022/0055851 A1 Feb. 24, 2022

Related U.S. Application Data

(63) Continuation of application No. 16/564,100, filed on Sep. 9, 2019, now abandoned.

(51) Int. Cl.

| | |
|---|---|
| ***B65H 7/04*** | (2006.01) |
| ***B65H 1/18*** | (2006.01) |
| ***B65H 1/04*** | (2006.01) |

(52) U.S. Cl.

CPC ..... *B65H 1/18* (2013.01); *B65H 1/04* (2013.01); *B65H 7/04* (2013.01); *B65H 2513/50* (2013.01)

(58) Field of Classification Search

CPC ... B65H 7/04; B65H 1/18; B65H 1/04; B65H 2513/50

See application file for complete search history.

(56) References Cited

U.S. PATENT DOCUMENTS

| | | | | |
|---|---|---|---|---|
| 3,907,283 | A | 9/1975 | Miller | |
| 9,670,019 | B2 | 6/2017 | Murata | |
| 10,654,673 | B2 | 5/2020 | Yamashita | |
| 10,793,387 | B2 * | 10/2020 | Shigeno | B65H 31/02 |
| 2010/0148420 | A1 | 6/2010 | Hamano et al. | |
| 2015/0368056 | A1 | 12/2015 | Murata | |

OTHER PUBLICATIONS

Non-Final Office Action for U.S. Appl. No. 16/564,100 dated Jun. 8, 2021.

Final Office Action for U.S. Appl. No. 16/564,100 dated Aug. 2, 2021.

* cited by examiner

*Primary Examiner* — Howard J Sanders

(74) *Attorney, Agent, or Firm* — AMIN, TUROCY & WATSON, LLP

(57) ABSTRACT

According to one embodiment, a sheet conveying device includes a placement tray, a presence detection sensor, and a control unit. The placement tray places a sheet thereon. The presence detection sensor detects the presence or absence of the sheet on the placement tray. The control unit delays a determination timing of the presence or absence of the sheet placed on the placement tray to a predetermined timing when a condition indicating that the remaining sheets placed on the placement tray are only a few is satisfied.

12 Claims, 9 Drawing Sheets

SHEET CONVEYING DEVICE, IMAGE FORMING APPARATUS, AND SHEET PRESENCE OR ABSENCE DETERMINATION METHOD

CROSS-REFERENCE TO RELATED APPLICATION

This application is a Continuation of application Ser. No. 16/564,100 filed on Sep. 9, 2019, the entire contents of which are incorporated herein by reference.

FIELD

Embodiments described herein relate generally to a sheet conveying device, an image forming apparatus, and a sheet presence or absence determination method.

BACKGROUND

In recent years, in a sheet conveying device, it is required to exchange an original document on a sheet on a placement tray at a higher speed. In order to make a sheet feeding timing faster, a next-sheet feeding sensor is provided at a position closer to the placement tray even with a slight amount. The next-sheet feeding sensor detects that a fed sheet is conveyed downstream in a sheet conveyance direction than a position where the next-sheet feeding sensor is provided. That is, the next-sheet feeding sensor can detect that it is time to start feeding the next sheet. A presence detection sensor that detects the presence or absence of a sheet to be fed is provided on the downstream of the placement tray in the sheet conveyance direction. However, due to the configuration, the presence detection sensor may not be able to immediately detect that the sheet on the placement tray ran out. In this case, the sheet conveying device starts a sheet feeding operation even though the sheet to be fed is not on the placement tray. As a result, it is determined that the fed sheet is jammed halfway. As a distance on a conveyance path between a position where the next-sheet feeding sensor is provided and a position where the presence detection sensor is provided is shorter, such jamming detection is more remarkable and the frequency of occurrence of jamming also increases.

DETAILED DESCRIPTION

In general, according to one embodiment, a sheet conveying device includes a placement tray, a presence detection sensor, and a control unit. The placement tray places a sheet thereon. The presence detection sensor detects the presence or absence of the sheet on the placement tray. The control unit delays a determination timing of the presence or absence of the sheet placed on the placement tray to a predetermined timing when a condition indicating that the remaining sheets placed on the placement tray are only a few is satisfied.

Hereinafter, a sheet conveying device, an image forming apparatus, and a sheet presence or absence determination method according to the embodiments will be described with reference to the drawings.

First Embodiment

Figure 1:
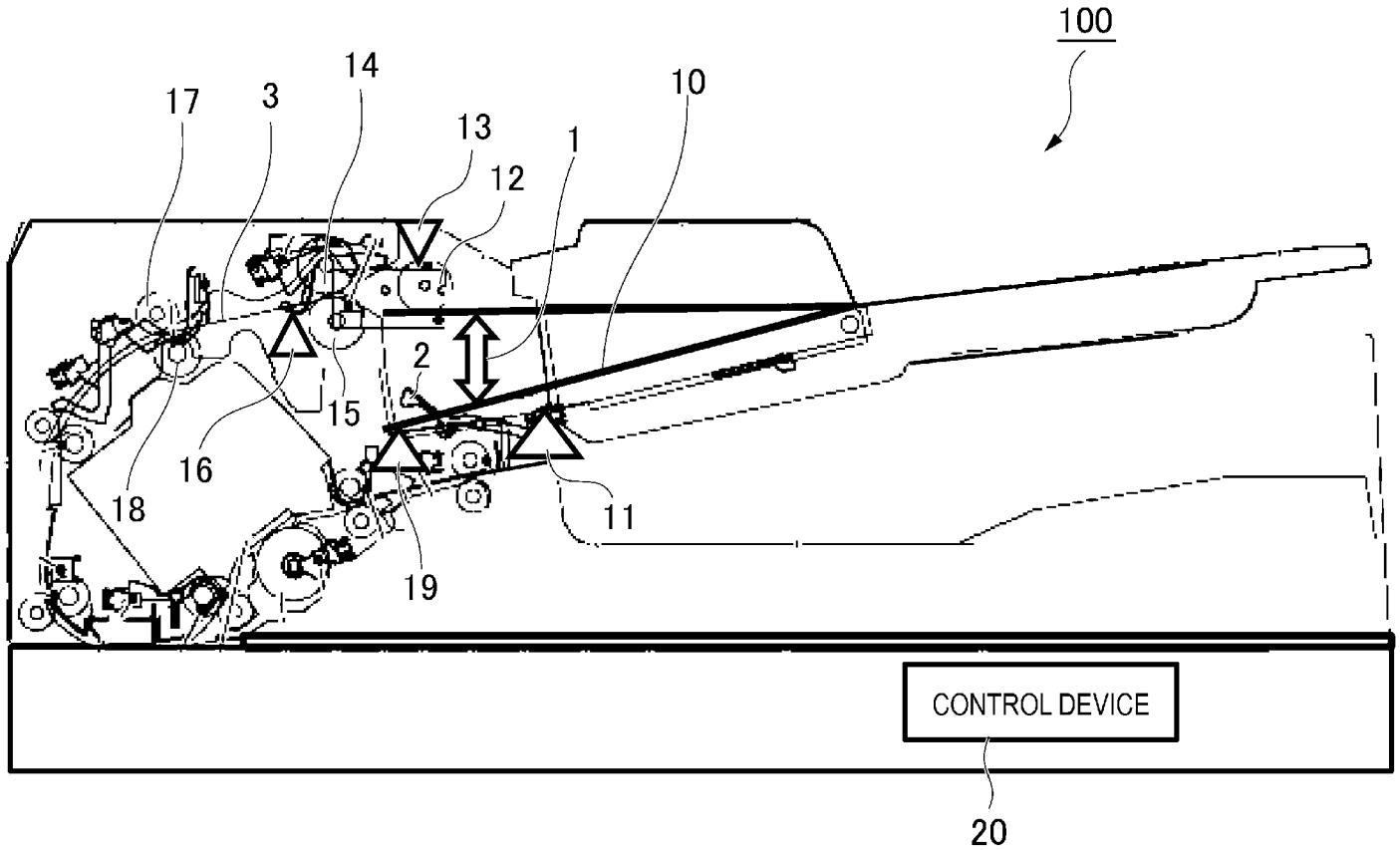
FIG. 1 is an external view illustrating an example of an overall configuration of a sheet conveying device according to a first embodiment.

FIG. 1 is an external view illustrating an example of an overall configuration of a sheet conveying device 100 according to a first embodiment. The sheet conveying device 100 according to the embodiment is a device for sequentially conveying the sheets placed on the placement tray one by one and reading an image on the sheet. The sheet is, for example, paper on which an original document, characters, an image, or the like is described. The sheet may be anything as long as the sheet conveying device 100 can read it.

The sheet conveying device 100 includes a placement tray 10, a presence detection sensor 11, a pickup roller 12, an upper limit sensor 13, a sheet feeding roller 14, a separation roller 15, a next-sheet feeding sensor 16, a conveyance roller 17, a registration roller 18, and a lower limit sensor 19, and a control device 20. The sheet conveying device 100 has a function of reading an image formed on the sheet and the like, but the description thereof is omitted here.

The placement tray 10 is a placement table on which the sheet is placed. The placement tray 10 operates up and down within the range indicated by an arrow 1. Specifically, the placement tray 10 operates up and down by control of a motor. The placement tray 10 is lifted to the upper limit position when the sheet is placed thereon, and is lowered to the lower limit position when the sheet on the placement tray is run out.

The lower limit position is the most lowered position in the range in which the placement tray 10 can operate. Whether it is the lower limit position or not is determined based on the detection result of the lower limit sensor 19. The upper limit position is a position at which the sheet can be fed, for example, a position at which the sheet or the placement tray 10 contacts the pickup roller 12. Whether or not it is the upper limit position is determined based on the detection result of the upper limit sensor 13.

The placement tray 10 includes an actuator 2 that blocks the light of the presence detection sensor 11 when the sheet is placed. The actuator 2 has a first end portion protruding onto the placement tray 10 and does not protrude in response to the sheet being placed. A second end portion is configured to block the light of the presence detection sensor 11 in response to the first end portion of the actuator 2 not protruding. When the sheet on the placement tray 10 ran out, the first end portion protrudes onto the placement tray 10 again. The second end portion is configured not to block the light of the presence detection sensor 11 in response to the first end portion of the actuator 2 protruding.

The first end portion of the actuator 2 does not protrude even by a single sheet, and thus it takes time to protrude even if the sheet on the placement tray 10 ran out. That is, even if the sheet on the placement tray 10 ran out, it takes time for the presence detection sensor 11 to detect that the sheet on the placement tray ran out.

The presence detection sensor 11 is a sensor that detects the presence or absence of a sheet on the placement tray 10. The presence detection sensor 11 is provided on the placement tray 10. In the presence detection sensor 11, when the sheet is placed on the placement tray 10, light is blocked by the second end portion of the actuator 2. As a result, the presence detection sensor 11 outputs a signal including a detection result (hereinafter referred to as "a sheet presence result") indicating that a sheet is present. In the following description, it is assumed that the presence detection sensor 11 is ON when the presence detection sensor 11 outputs a signal including the sheet presence result.

The presence detection sensor 11 outputs a signal including a detection result (hereinafter referred to as "a sheet absence result") indicating that there is no sheet when a sheet is not present on the placement tray 10. In the following description, it is assumed that the presence detection sensor 11 is OFF when the presence detection sensor 11 outputs a signal including the sheet absence result. The presence detection sensor 11 is an optical sensor, for example, a transmission-type sensor.

The pickup roller 12 is a roller for feeding the sheet on the placement tray 10 to a conveyance path 3.

The upper limit sensor 13 is a sensor configured to detect a position which is the upper limit position where an object (for example, the placement tray 10 or a sheet) comes in contact with the pickup roller 12. When the object is in contact with the pickup roller 12, the upper limit sensor 13 outputs a signal including a detection result indicating that the object is at the upper limit position. In the following description, it is assumed that the upper limit sensor 13 is ON when the upper limit sensor 13 outputs a signal including the detection result indicating that it is the upper limit position. When the object is not in contact with the pickup roller 12, the upper limit sensor 13 outputs a signal including the detection result indicating that the object is not at the upper limit position. In the following description, it is assumed that the upper limit sensor is OFF when the upper limit sensor 13 outputs a signal including the detection result indicating that it is not the upper limit position. The upper limit sensor 13 is an optical sensor, for example, a transmission-type sensor.

The sheet feeding roller 14 feeds the sheet fed by the pickup roller 12 to the conveyance path 3. The sheet feeding roller 14 is installed at a position facing the separation roller 15. The sheet feeding roller 14 rotates in the same direction as the pickup roller 12.

The separation roller 15 separates a sheet to be fed and the other sheets. The sheet to be fed is a sheet fed by the sheet feeding roller 14. The separation roller 15 rotates in the opposite direction to the sheet feeding roller 14 to separate the sheet to be fed and the other sheets fed in succession to the sheet to be fed.

The next-sheet feeding sensor 16 is a sensor that detects a sheet passing on the conveyance path 3. For example, the next-sheet feeding sensor 16 detects whether or not a sheet is present at a detection position of its own sensor. When the sheet is present at the detection position, the next-sheet feeding sensor 16 outputs a signal including the sheet presence result. In the following description, it is assumed that the next-sheet feeding sensor is ON when the next-sheet feeding sensor 16 outputs a signal including the sheet presence result. When there is no sheet at the detection position, the next-sheet feeding sensor 16 outputs a signal including the sheet absence result. In the following description, it is assumed that the next-sheet feeding sensor OFF when the next-sheet feeding sensor 16 outputs a signal including the sheet absence result.

The next-sheet feeding sensor 16 is used to detect the timing when feeding of the next sheet can be started. Specifically, the timing when the next-sheet feeding sensor 16 detects that there is no sheet after the next-sheet feeding sensor 16 detects that the sheet is present at the detection position is the timing when feeding of the next sheet can be started. The next-sheet feeding sensor 16 is an optical sensor, for example a transmission-type sensor.

The conveyance roller 17 conveys the sheet conveyed on the conveyance path 3 to the downstream side. Here, in the description of the embodiment, a place where the sheet is fed is referred to as the upstream side, and a place where the sheet is discharged is referred to as the downstream side.

After temporarily stopping sheet conveyance, the registration roller 18 conveys the sheet conveyed on the conveyance path 3 to the downstream side. Accordingly, the registration roller 18 can adjust the output timing of the sheet. The registration roller 18 is also used to adjust an inclination of the sheet.

The lower limit sensor 19 is a sensor configured to detect the lower limit position of the placement tray 10. The lower limit sensor 19 outputs a signal including the detection result indicating that it is the lower limit position when the placement tray 10 is positioned at the lower limit position. The lower limit sensor 19 outputs a signal including the detection result indicating that it is not the lower limit position when the placement tray 10 is not positioned at the lower limit position. The lower limit sensor 19 is an optical sensor, for example, a transmission-type sensor.

The control device 20 controls the operation of the sheet conveying device 100. For example, the control device 20 controls the sheet conveyance and the roller rotation.

Figure 2:
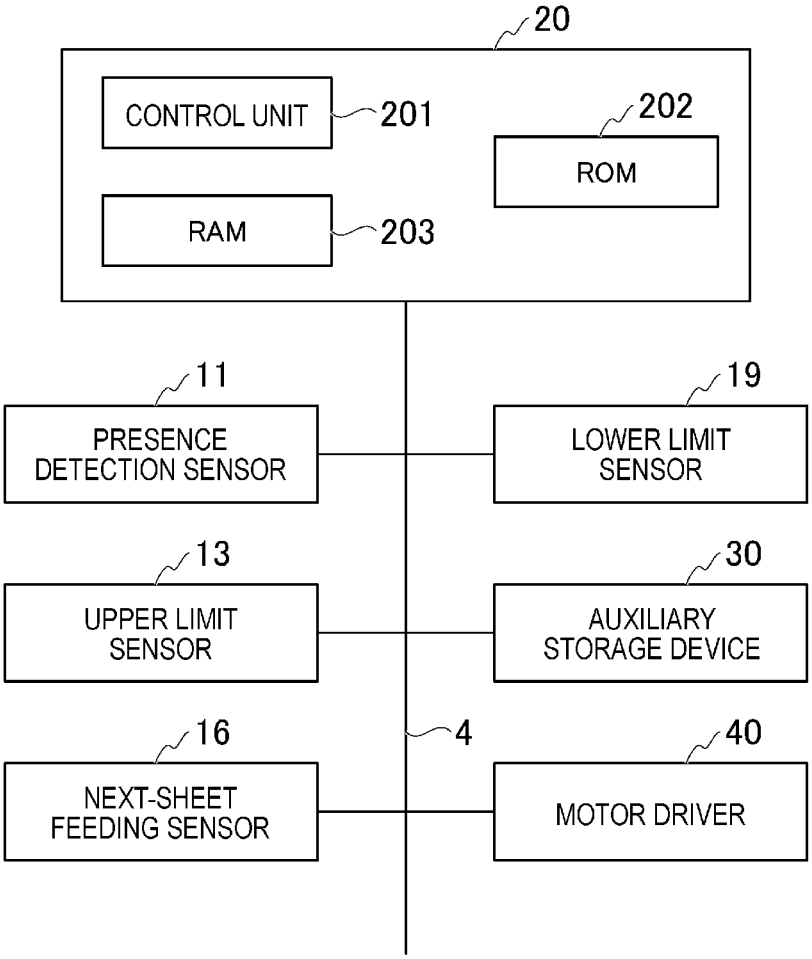
FIG. 2 is a block diagram illustrating a hardware configuration of the sheet conveying device.

FIG. 2 is a block diagram illustrating a hardware configuration of the sheet conveying device 100 in the first embodiment. In FIG. 2, only the characteristic hardware configuration of the sheet conveying device 100 in the first embodiment is illustrated.

The sheet conveying device 100 includes the presence detection sensor 11, the upper limit sensor 13, the next-sheet feeding sensor 16, the lower limit sensor 19, the control device 20, an auxiliary storage device 30, and a motor driver 40. Respective functional units are connected to each other to be capable of data communication via a system bus 4.

The presence detection sensor 11, the upper limit sensor 13, the next-sheet feeding sensor 16, and the lower limit sensor 19 are described above, and thus the description thereof is omitted. Hereinafter, the control device 20, the auxiliary storage device 30, and the motor driver 40 will be described.

The control device 20 includes a control unit 201, a read only memory (ROM) 202, and a random access memory (RAM) 203. The control unit 201 is, for example, a processor such as a central processing unit (CPU) or a graphics processing unit (GPU). The control unit 201 controls the operation of each functional unit of the sheet conveying device 100. The control unit 201 develops a program stored in the ROM 202 into the RAM 203 and executes the program to execute various processes. An application specific integrated circuit (ASIC) may have an appropriate function realized by the control unit 201. The ASIC is a dedicated circuit for implementing a specific function.

The ROM 202 stores a program for operating the control unit 201.

The RAM 203 temporarily stores data used by each functional unit of the sheet conveying device 100.

The auxiliary storage device 30 is, for example, a hard disk or a solid state drive (SSD), and stores various data. The various data are, for example, digital data, jobs, and job logs.

The motor driver 40 controls motors for rotating various rollers of the sheet conveying device 100 and a motor for operating the placement tray 10.

Next, a specific process of the control unit 201 will be described. When a predetermined condition is satisfied, the control unit 201 delays the determination timing of the presence or absence of the sheet placed on the placement tray 10 to a predetermined timing. The predetermined condition is a condition indicating that the remaining sheets placed on the placement tray 10 are only a few. The control unit 201 determines that the predetermined condition is satisfied, for example, when a lifted amount of the placement tray 10 becomes equal to or greater than a specified value in a series of sheet feeding. Feeding a series of sheets means successively feeding a plurality of sheets placed on the placement tray 10.

When the sheets are successively fed, the number of remaining sheets on the placement tray 10 is reduced. Along with this, the placement tray 10 is lifted. Accordingly, when the number of remaining sheets placed on the placement tray 10 is small, the lifted amount of the placement tray 10 becomes high. The control unit 201 determines whether or not the predetermined condition is satisfied, by comparing the lifted amount with a specified value defined in advance.

The lifted amount is calculated based on the lifting time of the placement tray 10 from the lower limit position to the upper limit position and the time from the start of the lifting of the placement tray 10 to the stop of the lifting of the placement tray 10 during the feeding of the sheet. In the first embodiment, the predetermined timing is the timing when a predetermined time elapsed from the time point when the next-sheet feeding sensor becomes OFF from ON. The control unit 201 determines the presence or absence of the sheet based on the detection result of the presence detection sensor 11 obtained after a predetermined time elapsed from the time point when the next-sheet feeding sensor becomes OFF from ON. That is, even though the next-sheet feeding sensor is OFF, the control unit 201 does not immediately determine the presence or absence of the sheet based on the detection result of the presence detection sensor 11. Thus, the control unit 201 delays the determination timing of the presence or absence of the sheet placed on the placement tray 10.

Figure 3:
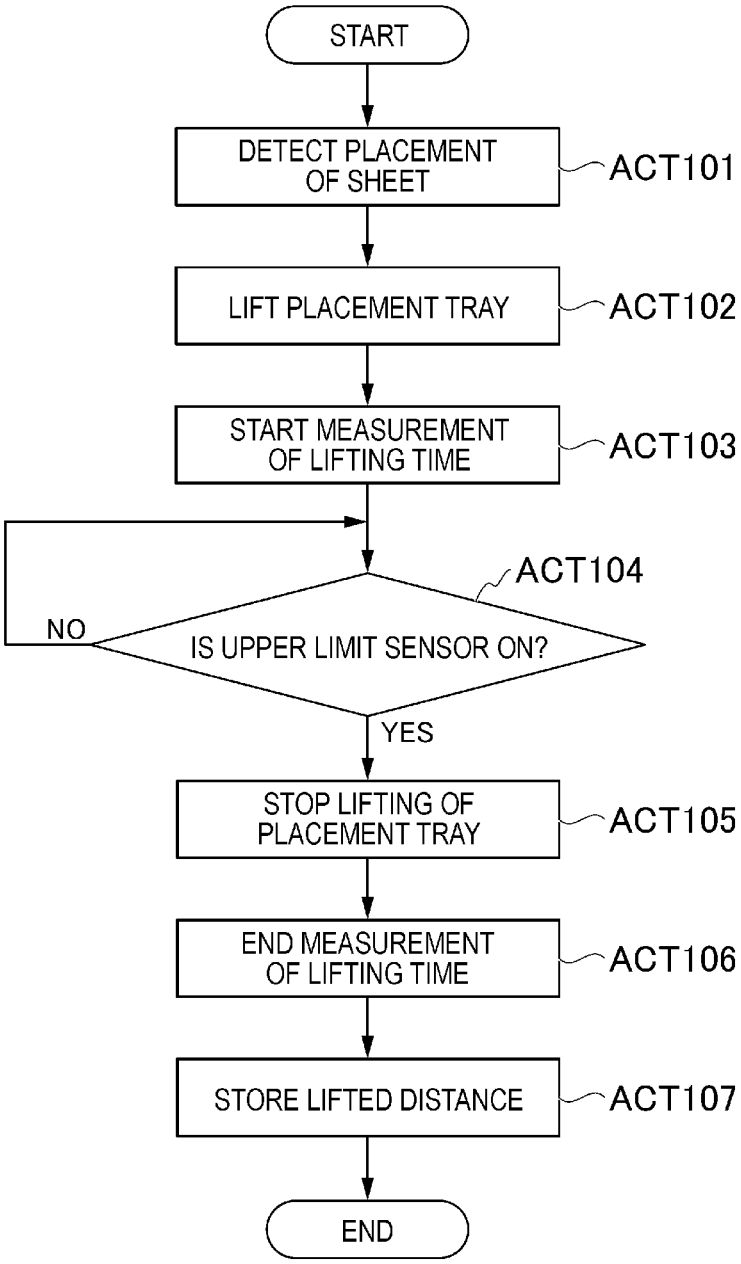
FIG. 3 is a flowchart illustrating a flow of processing when a sheet is placed.

FIG. 3 is a flowchart illustrating a flow of processing when the sheet is placed by the sheet conveying device 100 in the first embodiment.

When the sheet is placed on the placement tray 10, the presence detection sensor 11 detects the placement of the sheet (ACT 101). In this case, the presence detection sensor 11 outputs a signal including the sheet presence result to the control device 20. Thereafter, the placement tray 10 is lifted to start a sheet feeding operation.

Specifically, the control unit 201 controls the motor driver 40 to lift the placement tray 10 up to the upper limit position. The motor driver 40 causes the motor of the placement tray 10 to rotate according to the control of the control unit 201 to lift the placement tray 10 until the placement tray 10 reaches the upper limit position (ACT 102).

The control unit 201 starts measurement of the lifting time at the timing of the lifting start of the placement tray 10 (ACT 103). The control unit 201 determines whether or not the upper limit sensor 13 is ON (ACT 104). When it is determined that the upper limit sensor 13 is ON, the detection result indicating that it is the upper limit position is acquired from the upper limit sensor 13. When the detection result indicating that it is the upper limit position is acquired from the upper limit sensor 13, the control unit 201 determines that the upper limit sensor 13 is ON. In this case, the placement tray 10 reaches the upper limit position.

On the other hand, when the control unit 201 determines that the upper limit sensor 13 is not ON, that is, when the upper limit sensor 13 is OFF, a detection result indicating that it is not the upper limit position is acquired from the upper limit sensor 13. When the detection result indicating that it is not the upper limit position is acquired from the upper limit sensor 13, the control unit 201 determines that the upper limit sensor 13 is not ON. In this case, the placement tray 10 does not reach the upper limit position.

When the control unit 201 determines that the upper limit sensor 13 is not ON (NO in ACT 104), the control unit 201 waits until the placement tray 10 reaches the upper limit position.

On the other hand, when the control unit 201 determines that the upper limit sensor 13 is ON (YES in ACT 104), the control unit 201 controls the motor driver 40 to stop lifting of the placement tray 10. The motor driver 40 stops the rotation of the motor of the placement tray 10 according to control of the control unit 201, and stops lifting of the placement tray 10 (ACT 105).

The control unit 201 ends the measurement of the lifting time at the timing when the lifting of the placement tray 10 is ended (ACT 106). As such, the control unit 201 measures a first time from the start of the lifting of the placement tray 10 to the stop of the lifting of the placement tray 10. The control unit 201 calculates a first lifted distance using the measured first time. Lifting speed of the placement tray 10 is preset. The control unit 201 stores a calculated first lifted distance in the RAM 203 or the auxiliary storage device 30 (ACT 107). The first lifted distance decreases as the number of sheets placed on the placement tray 10 increases. The first lifted distance increases as the number of sheets placed on the placement tray 10 decreases.

Figure 4:
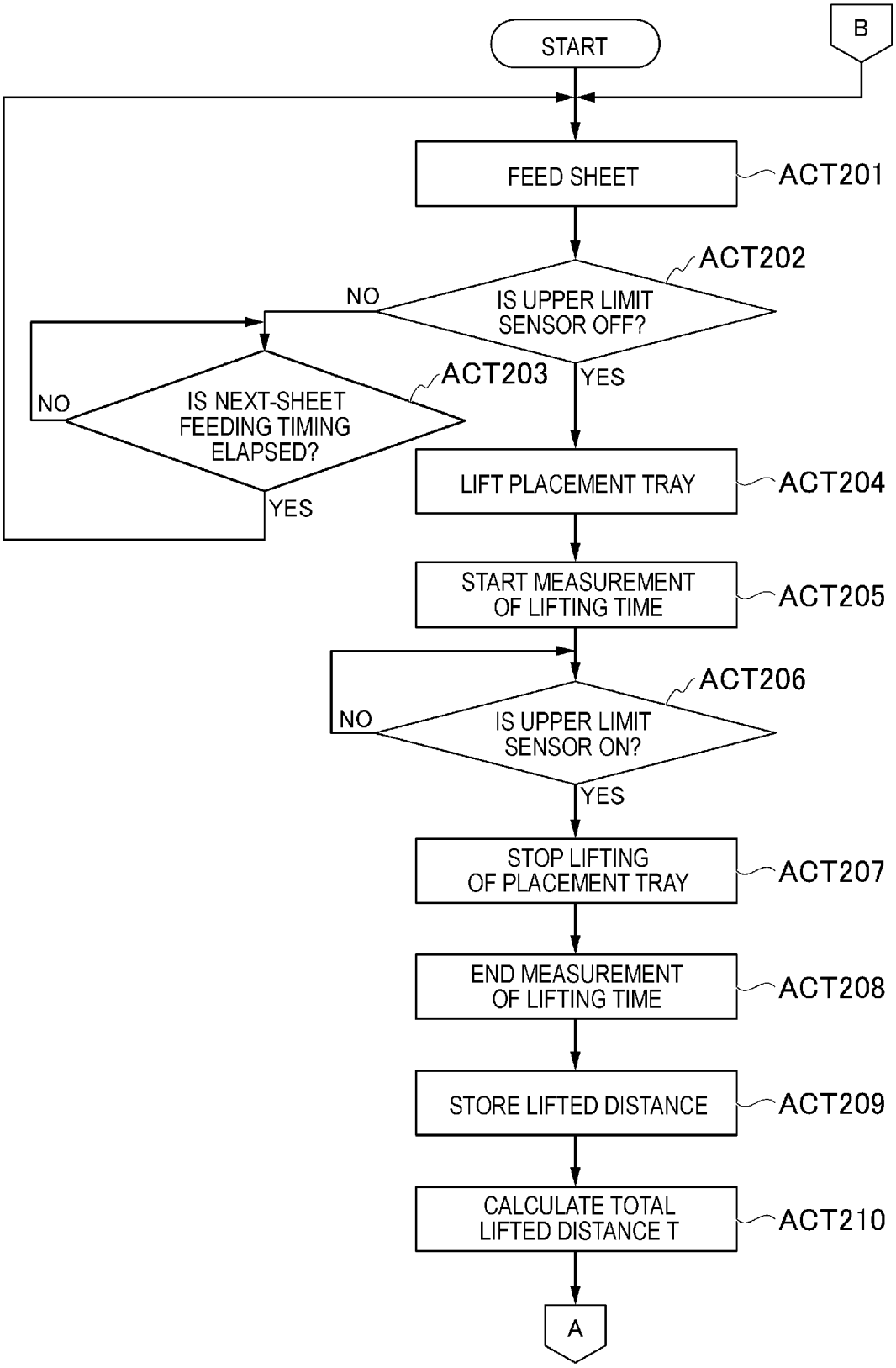
FIG. 4 is a flowchart illustrating a flow of a sheet presence or absence determination process.
Figure 5:
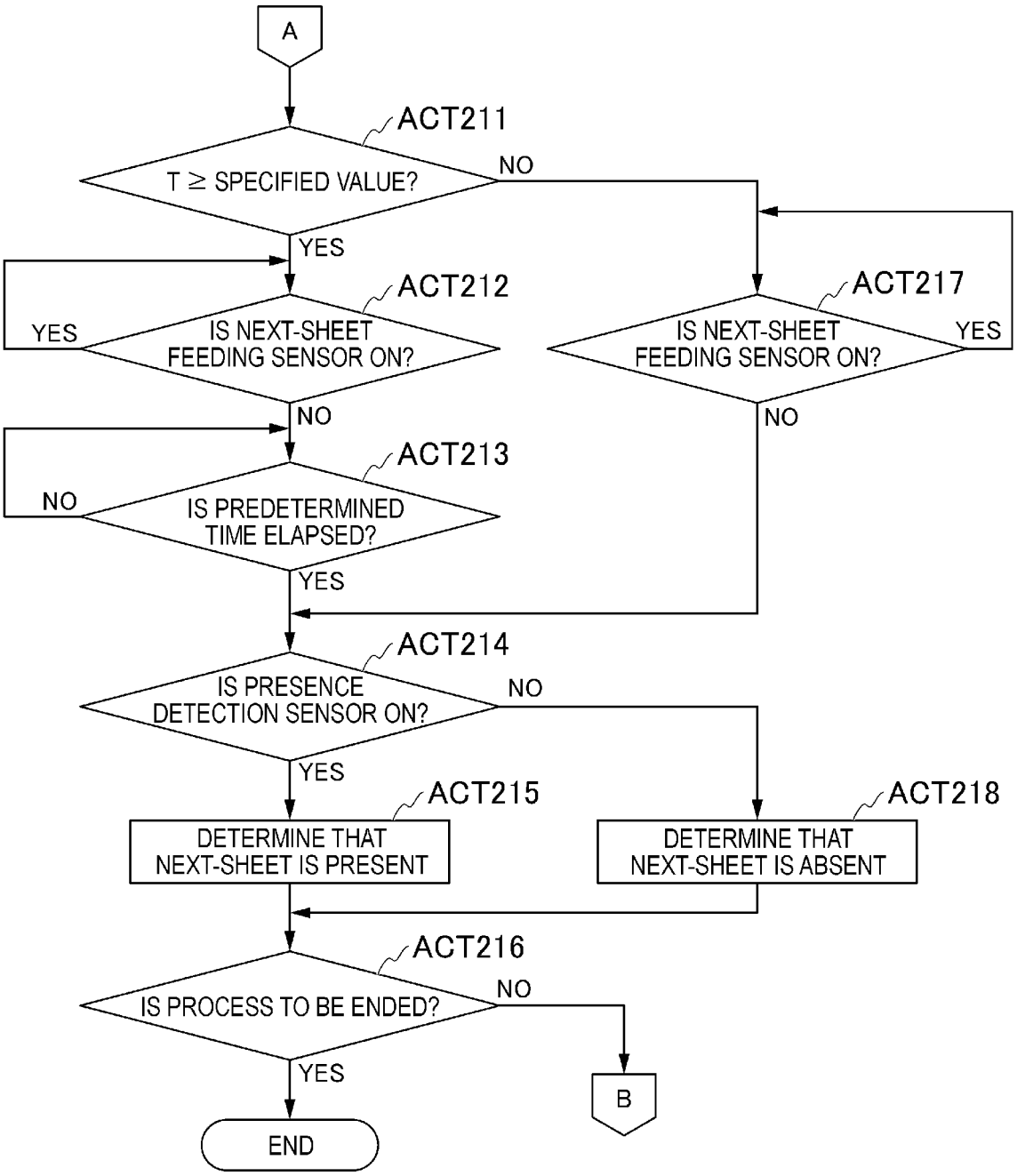
FIG. 5 is a flowchart illustrating a flow of the sheet presence or absence determination process.

FIGS. 4 and 5 are flowcharts illustrating a flow of the sheet presence or absence determination process performed by the sheet conveying device 100 in the first embodiment. The process in FIGS. 4 and 5 are performed when the placement tray 10 is positioned at the upper limit position.

The pickup roller 12 is driven by the rotation of the motor to feed the sheet to the conveyance path 3 (ACT 201). When sheets are continuously fed, a loading amount of sheets on the placement tray 10 is reduced, and the sheets do not contact the pickup roller 12. The control unit 201 determines whether or not the upper limit sensor 13 is OFF (ACT 202).

When the control unit 201 determines that the upper limit sensor 13 is ON (NO in ACT 202), the placement tray 10 is positioned at the upper limit position. Thereafter, the control unit 201 determines whether or not the sheet feeding timing for the next sheet elapsed (ACT 203). Specifically, after the sheet presence result is acquired from the next-sheet feeding sensor 16, when the sheet absence result is acquired, the control unit 201 determines that the next-sheet feeding timing elapsed. That is, when the next-sheet feeding sensor 16 becomes from ON to OFF, the control unit 201 determines that the next-sheet feeding timing elapsed. In any other cases, the control unit 201 determines that the next-sheet feeding timing does not elapse. Any other cases correspond to a case where the sheet presence result is continuously acquired from the next-sheet feeding sensor 16 and a case where the sheet absence result is continuously acquired from the next-sheet feeding sensor 16.

When the control unit 201 determines that the next-sheet feeding timing does not elapse (NO in ACT 203), the controller 201 waits until the next-sheet feeding timing elapses.

On the other hand, when the control unit 201 determines that the next-sheet feeding timing elapsed (YES in ACT 203), the control unit 201 executes the process of ACT 201. Specifically, the control unit 201 controls the motor driver 40 to feed the next sheet. The motor driver 40 controls the motor of the pickup roller 12 to feed a sheet, according to the control unit 201. The pickup roller 12 rotates with the operation of the motor of the pickup roller 12. As a result, the sheet in contact with the pickup roller 12 is fed.

When the control unit 201 determines that the upper limit sensor 13 is OFF (YES in ACT 202) in the process of ACT 202, the placement tray 10 is not positioned at the upper limit position. Accordingly, the control unit 201 controls the motor driver 40 to lift the placement tray 10 to the upper limit position. The motor driver 40 controls the motor of the placement tray 10 to lift the placement tray 10 until the placement tray 10 reaches the upper limit position, according to the control unit 201 (ACT 204).

The control unit 201 starts measurement of the lifting time at the timing of the lifting start of the placement tray 10 (ACT 205). The control unit 201 determines whether or not the upper limit sensor 13 is ON (ACT 206). When the control unit 201 determines that the upper limit sensor 13 is not ON (NO in ACT 206), the control unit 201 waits until the placement tray 10 reaches the upper limit position.

On the other hand, when the control unit 201 determines that the upper limit sensor 13 is ON (YES in ACT 206), the control unit 201 controls the motor driver 40 to stop the lifting of the placement tray 10. The motor driver 40 stops the rotation of the motor of the placement tray 10 to stop the lifting of the placement tray 10, according to the control unit 201 (ACT 207).

The control unit 201 ends the measurement of the lifting time at the timing when the lifting of the placement tray 10 is ended (ACT 208). As such, the control unit 201 also measures a second time from the start of the lifting of the placement tray 10 to the stop of the lifting of the placement tray 10 even at the time of sheet feeding. The control unit 201 calculates a second lifted distance using the measured second time. The control unit 201 stores the calculated second lifted distance in the RAM 203 or the auxiliary storage device 30 (ACT 209).

Thereafter, the control unit 201 calculates a total lifted distance T which is a total value of the lifted distances stored in the RAM 203 or the auxiliary storage device 30 (ACT 210). Specifically, the control unit 201 calculates the total lifted distance T by adding the first lifted distance and the second lifted distance. The second lifted distance is calculated each time the placement tray 10 is lifted. Accordingly, the total lifted distance T increases each time the placement tray 10 is lifted.

The control unit 201 determines whether the total lifted distance T is equal to or greater than a specified value (ACT 211). When the total lifted distance T is determined to be equal to or greater than the specified value (YES in ACT 211), the control unit 201 determines that the predetermined condition is satisfied. In this case, the control unit 201 operates so as not to immediately determine the presence or absence of a sheet based on the detection result of the presence detection sensor 11 even though the next-sheet feeding sensor is OFF. The control unit 201 determines whether or not the next-sheet feeding sensor 16 is ON (ACT 212). When it is determined that the next-sheet feeding sensor 16 is ON, the sheet presence result is acquired from the next-sheet feeding sensor 16. When the sheet presence result is acquired from the next-sheet feeding sensor 16, the control unit 201 determines that the next-sheet feeding sensor 16 is ON. In this case, the sheet is positioned at a detection position of the next-sheet feeding sensor 16. That is, the sheet is detected by the next-sheet feeding sensor 16.

On the other hand, when it is determined that the next-sheet feeding sensor 16 is not ON, that is, when the next-sheet feeding sensor 16 is OFF, the sheet absence result is acquired from the next-sheet feeding sensor 16. When the sheet absence result is acquired from the next-sheet feeding sensor 16, the control unit 201 determines that the next-sheet feeding sensor 16 is not ON. In this case, the sheet is not positioned at the detection position of the next-sheet feeding sensor 16. That is, no sheet is detected by the next-sheet feeding sensor 16.

When it is determined that the next-sheet feeding sensor 16 is ON (YES in ACT 212), the control unit 201 waits until the sheet absence result is acquired from the next-sheet feeding sensor 16.

On the other hand, when it is determined that the next-sheet feeding sensor 16 is not ON (NO in ACT 212), the control unit 201 determines whether or not a predetermined time elapsed (ACT 213). Specifically, the control unit 201 determines whether or not a predetermined time elapsed from the time point when it is determined that the next-sheet feeding sensor 16 is not ON. The predetermined time is preset. For example, it is desirable that the predetermined time is a time from when the sheet on the placement tray 10 ran out until the presence detection sensor 11 can detect the absence of the sheet.

When it is determined that the predetermined time does not elapse (NO in ACT 213), the control unit 201 waits until the predetermined time elapses.

On the other hand, when it is determined that the predetermined time elapsed (YES in ACT 213), the control unit 201 determines whether or not the presence detection sensor 11 is ON (ACT 214). When it is determined that the presence detection sensor 11 is ON, the sheet presence result is acquired from the presence detection sensor 11. When the sheet presence result is acquired from the presence detection sensor 11, the control unit 201 determines that the presence detection sensor 11 is ON. In this case, a sheet is present on the placement tray 10.

On the other hand, when it is determined that the presence detection sensor 11 is not ON, that is, when the presence detection sensor 11 is OFF, the sheet absence result is acquired from the presence detection sensor 11. When the sheet absence result is acquired from the presence detection sensor 11, the control unit 201 determines that the presence detection sensor 11 is not ON. In this case, there is no sheet on the placement tray 10.

When it is determined that the presence detection sensor 11 is ON (YES in ACT 214), it means that the sheet is present on the placement tray 10. For that reason, the control unit 201 determines that a sheet to be fed next is present (ACT 215). Thereafter, the control unit 201 determines whether or not to end the process (ACT 216). When there is no sheet to be fed next, the control unit 201 determines that the processing is to be ended. When the sheet to be fed next is present, the control unit 201 determines that the processing is not to be ended. When it is determined that the processing is to be ended (YES in ACT 216), the control unit 201 ends the processing.

When it is determined that the processing is not to be ended (NO in ACT 216), the sheet conveying device 100 executes the process of ACT 201.

In the process of ACT 211, when it is determined that the total lifted distance T is less than the specified value (NO in ACT 211), the control unit 201 determines that the predetermined condition is not satisfied. In this case, as in the related art, the control unit 201 determines the presence or absence of the sheet based on the detection result of the presence detection sensor 11 at the time point when the next-sheet feeding sensor 16 is turned OFF. The control unit 201 determines whether or not the next-sheet feeding sensor 16 is ON (ACT 217). When it is determined that the next-sheet feeding sensor 16 is ON (YES in ACT 217), the control unit 201 waits until the sheet absence result is acquired from the next-sheet feeding sensor 16.

On the other hand, when it is determined that the next-sheet feeding sensor 16 is not ON (NO in ACT 217), the control unit 201 executes the subsequent processes of ACT 214.

In the process of ACT 214, when it is determined that the presence detection sensor 11 is not ON (NO in ACT 214), there is no sheet on the placement tray 10. For that reason, the control unit 201 determines that there is no sheet to be fed next (ACT 218). Thereafter, the sheet conveying device 100 executes the process of ACT 216.

The sheet conveying device 100 configured as described above performs the following process when the condition indicating that the remaining sheets placed on the placement tray 10 are only a few is satisfied. The sheet conveying device 100 delays the determination timing of the presence or absence of the sheet until a predetermined time elapses since the sheet absence result is obtained from the next-sheet feeding sensor 16. With this configuration, the determination timing of the presence or absence of the sheet based on the detection result of the presence detection sensor 11 can be delayed. As such, the sheet conveying device 100 determines the presence or absence of the sheet by considering the delay time of the return of the first end portion of the actuator 2 of the placement tray 10. Accordingly, when the sheet on the placement tray 10 ran out, a sufficient time until the presence detection sensor 11 is turned OFF can be secured. For that reason, an erroneous determination can be suppressed without lowering the efficiency. As a result, the occurrence of jamming can be prevented.

Second Embodiment

In the second embodiment, the sheet conveying device includes a plurality of next-sheet feeding sensors, and refers to the detection result of the next-sheet feeding sensor positioned on the downstream side when a predetermined condition is satisfied.

Figure 6:
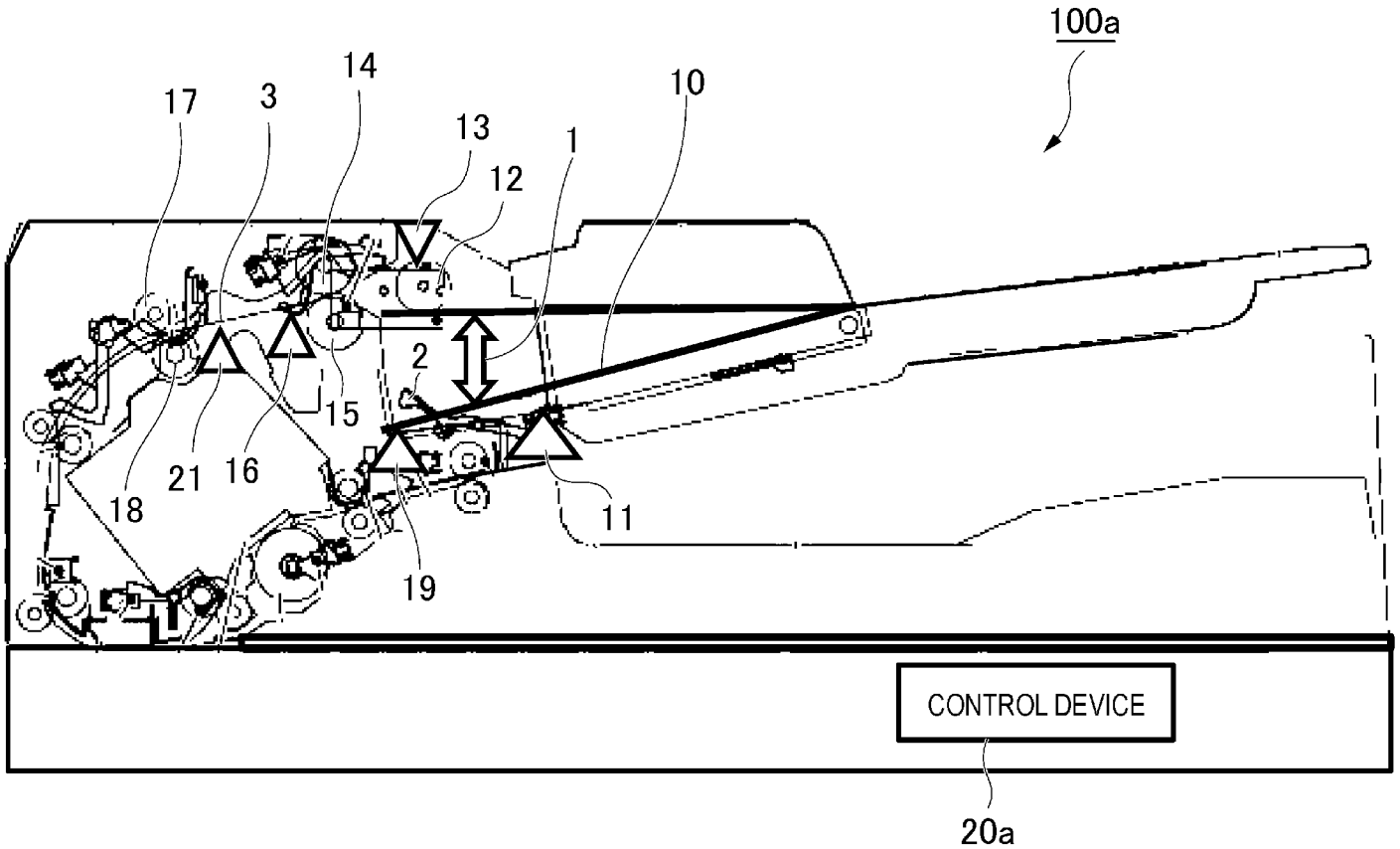
FIG. 6 is an external view illustrating an example of an overall configuration of a sheet conveying device according to a second embodiment.

FIG. 6 is an external view illustrating an example of an overall configuration of a sheet conveying device 100*a* according to a second embodiment. The sheet conveying device 100*a* includes the placement tray 10, the presence detection sensor 11, the pickup roller 12, the upper limit sensor 13, the sheet feeding roller 14, the separation roller 15, the next-sheet feeding sensor 16, the conveyance roller 17, the registration roller 18, the lower limit sensor 19, a control device 20*a*, and a second next-sheet feeding sensor 21. The sheet conveying device 100*a* has a function of reading an image formed on a sheet, but the description thereof is omitted here.

A configuration of the sheet conveying device 100*a* differs from that of the sheet conveying device 100 in that the control device 20*a* is included instead of the control device 20, and the second next-sheet feeding sensor 21 is newly included. The sheet conveying device 100*a* is the same as the sheet conveying device 100 in the other configuration. For that reason, the description of the entire sheet conveying device 100*a* is omitted, and the control device 20*a* and the second next-sheet feeding sensor 21 will be described.

As described above, the sheet conveying device 100*a* includes the next-sheet feeding sensor 16 and the second next-sheet feeding sensor 21. In the following description, in order to distinguish a plurality of next-sheet feeding sensors, the next-sheet feeding sensor 16 will be described as a first next-sheet feeding sensor.

The second next-sheet feeding sensor 21 performs the same process as the next-sheet feeding sensor 16. The second next-sheet feeding sensor 21 is provided downstream of the next-sheet feeding sensor 16. More specifically, the second next-sheet feeding sensor 21 is installed between the next-sheet feeding sensor 16 and the conveyance roller 17.

The control device 20*a* controls the operation of the sheet conveying device 100*a*. For example, the control device 20*a* controls the sheet conveyance and roller rotation.

Figure 7:
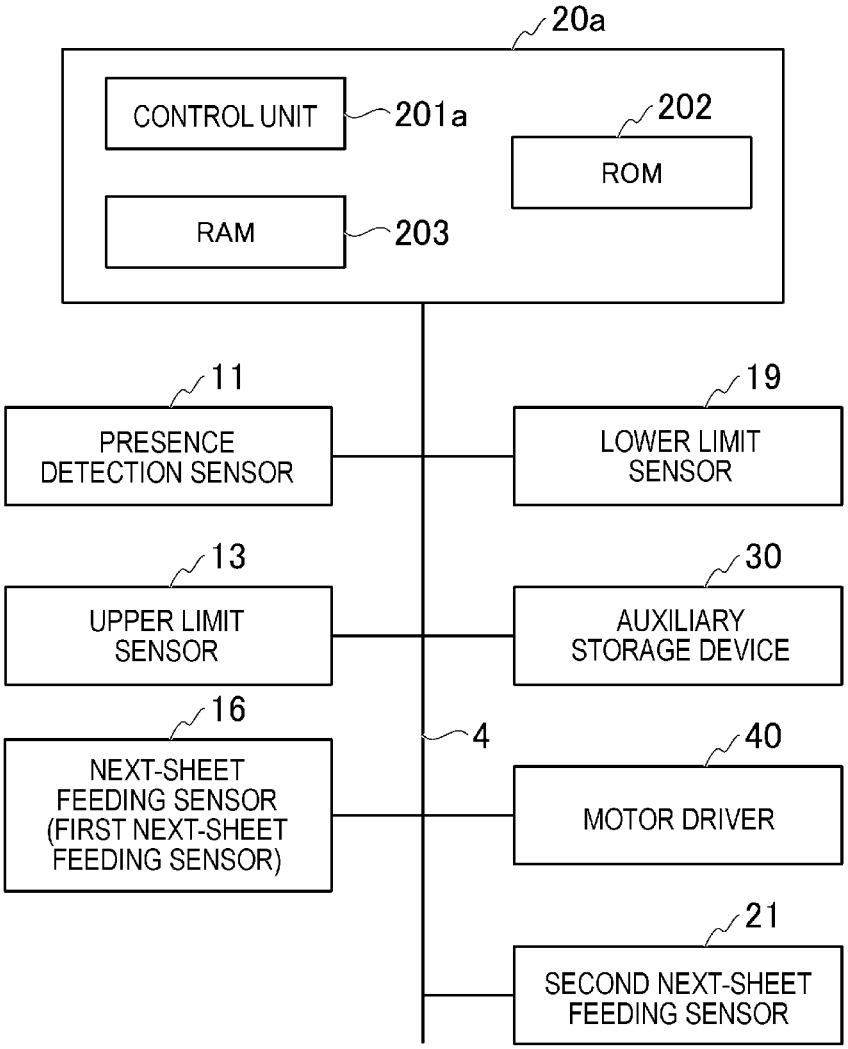
FIG. 7 is a block diagram illustrating a hardware configuration of the sheet conveying device.

FIG. 7 is a block diagram illustrating a hardware configuration of the sheet conveying device 100*a* in the second embodiment. In FIG. 7, only the characteristic hardware configuration of the sheet conveying device 100*a* in the second embodiment is illustrated.

The sheet conveying device 100*a* includes the presence detection sensor 11, the upper limit sensor 13, the next-sheet feeding sensor 16, the lower limit sensor 19, the control device 20*a*, the second next-sheet feeding sensor 21, the auxiliary storage device 30, and the motor driver 40. Respective functional units are connected to each other to be capable of data communication via the system bus 4.

The presence detection sensor 11, the upper limit sensor 13, the next-sheet feeding sensor 16, the lower limit sensor 19, the second next-sheet feeding sensor 21, the auxiliary storage device 30, and the motor driver 40 are described above, and thus the description thereof is omitted. In the following, the control device 20*a* will be described.

The control device 20*a* includes a control unit 201*a*, the ROM 202, and the RAM 203. The control unit 201*a* is, for example, a processor such as a CPU or a GPU. The control unit 201*a* controls the operation of each functional unit of the sheet conveying device 100*a*. The control unit 201*a* develops a program stored in the ROM 202 into the RAM 203 and executes the program to execute various processes. The ASIC may have an appropriate function realized by the control unit 201*a*.

Next, specific processing of the control unit 201*a* will be described. When the predetermined condition is satisfied, the control unit 201*a* delays the determination timing of the presence or absence of the sheet placed on the placement tray 10 to the predetermined timing. For example, when the lifted amount of the placement tray 10 becomes equal to or greater than the specified value in the series of sheet feeding, the control unit 201*a* determines that the predetermined condition is satisfied. In the second embodiment, the predetermined timing is the timing when the second next-sheet feeding sensor 21 is changed from ON to OFF. The control unit 201*a* determines the presence or absence of a sheet based on the detection result of the presence detection sensor 11 obtained after the second next-sheet feeding sensor 21 is changed from ON to OFF. That is, the control unit 201 determines the presence or absence of the sheet based on the detection result of the presence detection sensor 11 at the timing when the second next-sheet feeding sensor 21 is changed from ON to OFF. Since the second next-sheet feeding sensor 21 is positioned downstream of the next-sheet feeding sensor 16, the time from the detection of a sheet of the presence detection sensor 11 to the determination timing of the next-sheet feeding becomes longer than that in the related art. Thus, the control unit 201*a* delays the determination timing of the presence or absence of the sheet placed on the placement tray 10.

Figure 8:
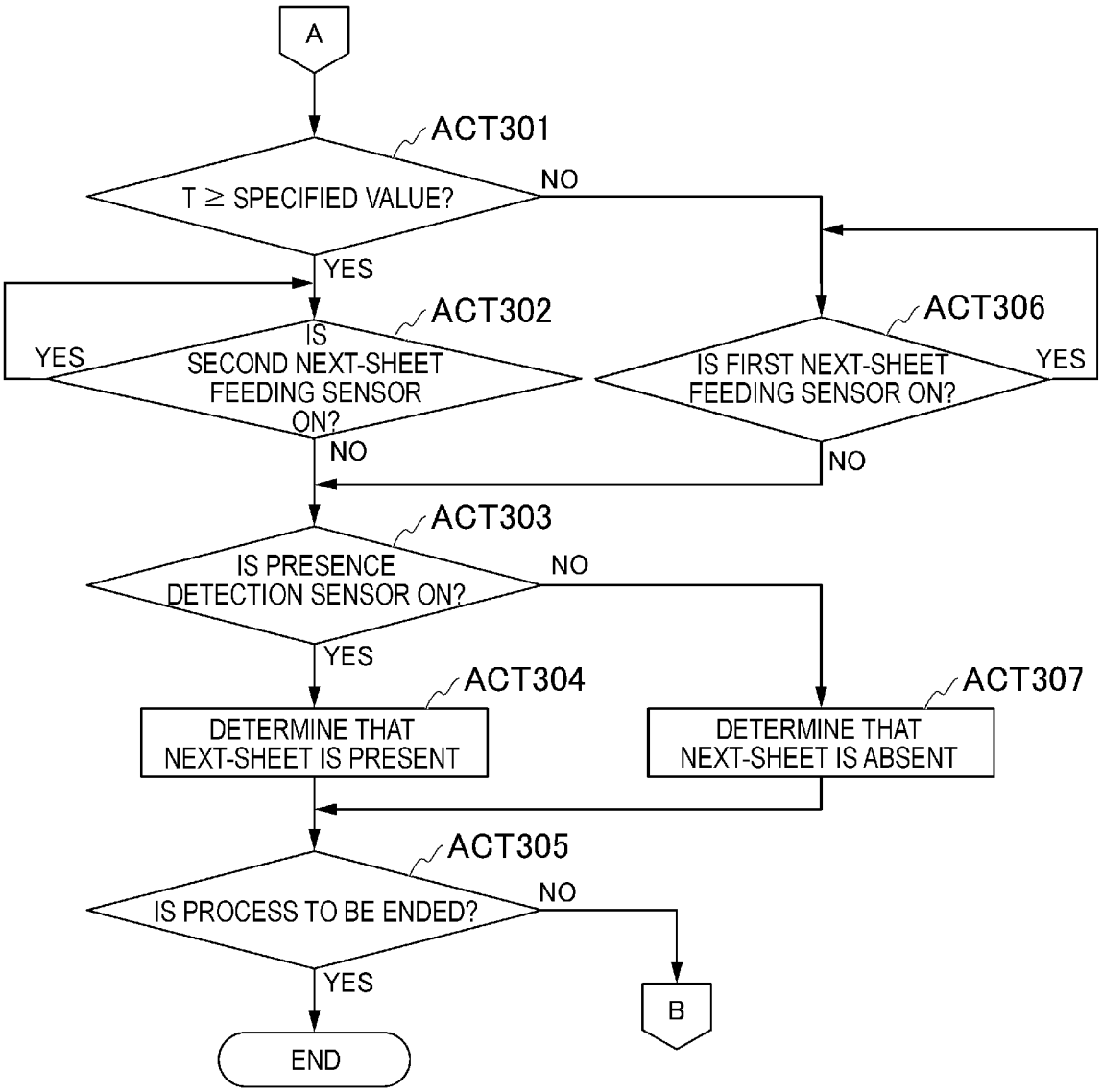
FIG. 8 is a flowchart illustrating a flow of the sheet presence or absence determination processing.

FIG. 8 is a flowchart illustrating a flow of sheet presence or absence determination processing performed by the sheet conveying device 100*a* in the second embodiment. The processing in FIG. 8 is executed after the process of ACT 210 in FIG. 4. The processes from ACT 201 to ACT 210 are described with reference to FIG. 4, and thus the descriptions thereof are omitted.

The control unit 201*a* determines whether or not the total lifted distance T is equal to or greater than a specified value (ACT 301). When the total lifted distance T is determined to be equal to or greater than the specified value (YES in ACT 301), the control unit 201*a* determines that the predetermined condition is satisfied. In this case, the control unit 201*a* operates to determine the presence or absence of a sheet based on the detection result of the presence detection sensor 11 at the time point when the second next-sheet feeding sensor 21 is turned OFF. The control unit 201*a* determines whether or not the second next-sheet feeding sensor 21 is ON (ACT 302). A determination criterion as to whether or not the second next-sheet feeding sensor 21 is ON is the same as the determination criterion as to whether or not the next-sheet feeding sensor 16 is ON, and thus the description thereof is omitted.

When it is determined that the second next-sheet feeding sensor 21 is ON (YES in ACT 302), the control unit 201*a* waits until the sheet presence result is not acquired from the second next-sheet feeding sensor 21.

On the other hand, when it is determined that the second next-sheet feeding sensor 21 is not ON (NO in ACT 302), the control unit 201*a* determines whether or not the presence detection sensor 11 is ON (ACT 303). When it is determined that the presence detection sensor 11 is ON (YES in ACT 303), it means that a sheet is present on the placement tray 10. For that reason, the control unit 201*a* determines that a sheet to be fed next is present (ACT 304). Thereafter, the control unit 201*a* determines whether or not to end the processing (ACT 305). When there is no sheet to be fed next, the control unit 201*a* determines that the processing is to be ended. When the sheet to be fed next is present, the control unit 201*a* determines that the processing is not to be ended. When it is determined that the processing is to be ended (YES in ACT 205), the control unit 201*a* ends the processing.

When it is determined that the processing is not to be ended (NO in ACT 205), the control unit 201*a* executes the process of ACT 201.

In the process of ACT 301, when it is determined that the total lifted distance T is less than the specified value (NO in ACT 301), the control unit 201*a* determines that the predetermined condition is not satisfied. In this case, the control unit 201*a* determines the presence or absence of a sheet based on the detection result of the presence detection sensor 11 at the time point when the next-sheet feeding sensor 16 is turned OFF, as in the related art.

The control unit 201*a* determines whether or not the next-sheet feeding sensor 16 is ON (ACT 306). When it is determined that the next-sheet feeding sensor 16 is ON (YES in ACT 306), the control unit 201*a* waits until a sheet absence result is acquired from the next-sheet feeding sensor 16.

On the other hand, when it is determined that the next-sheet feeding sensor 16 is not ON (NO in ACT 306), the control unit 201*a* executes the subsequent processes of ACT 303.

In the process of ACT 303, when it is determined that the presence detection sensor 11 is not ON (NO in ACT 305), it means that there is no sheet on the placement tray 10. For that reason, the control unit 201*a* determines that there is no sheet to be fed next (ACT 307). Thereafter, the sheet conveying device 100*a* executes the process of ACT 305.

The sheet conveying device 100*a* configured as described above performs the following processing when the condition indicating that the remaining sheets placed on the placement tray 10 are only a few is satisfied. The sheet conveying device 100*a* delays the determination timing of the presence or absence of the sheet until the second next-sheet feeding sensor 21 obtains the sheet absence result. With this configuration, the time from the detection of the sheet by the presence detection sensor 11 to the determination timing of the next-sheet feeding becomes longer than that in the related art. As such, the sheet conveying device 100 determines the presence or absence of the sheet by considering the delay time of the return of the first end portion of the actuator 2 of the placement tray 10. Accordingly, when the sheet on the placement tray 10 ran out, a sufficient time until the presence detection sensor 11 is turned OFF can be secured. Therefore, an erroneous determination can be suppressed without lowering efficiency. As a result, the occurrence of jamming can be prevented.

Hereinafter, modification examples common to the first and second embodiments will be described.

When the lifted amount of the tray becomes equal to or greater than the specified amount, the determination timing of the detection result of the presence detection sensor 11 is delayed. For that reason, the sheet feeding timing of the next sheet is later than the sheet feeding timing in the related art. As a result, the document exchange speed is reduced. Some users prefer to prioritize the document exchange speed over the risk of jamming caused by an erroneous determination of the sheet presence result. The sheet conveying devices 100 and 100*a* may be configured to be able to switch between the enabling and disabling of the first control that delays the determination timing as described above. When configured as described above, the sheet conveying devices 100 and 100*a* may have a first mode and a second mode in which the document exchange speed is prioritized. Then, the control units 201 and 201*a* switch between the first mode and the second mode according to the user's operation.

With this configuration, the mode can be switched freely according to the user's request. Accordingly, the convenience can be improved.

In the first and second embodiments described above, as the predetermined condition, the case where the lifted amount of the placement tray 10 is equal to or greater than the specified value is described as an example. The predetermined condition may be that a predetermined number of sheets placed on the placement tray 10 are fed. In this case, when the predetermined number of sheets placed on the placement tray is fed, the control unit 201 determines that the predetermined condition is satisfied. When the predetermined number of sheets placed on the placement tray 10 is not fed, the control unit 201 determines that the predetermined condition is not satisfied.

Figure 9:
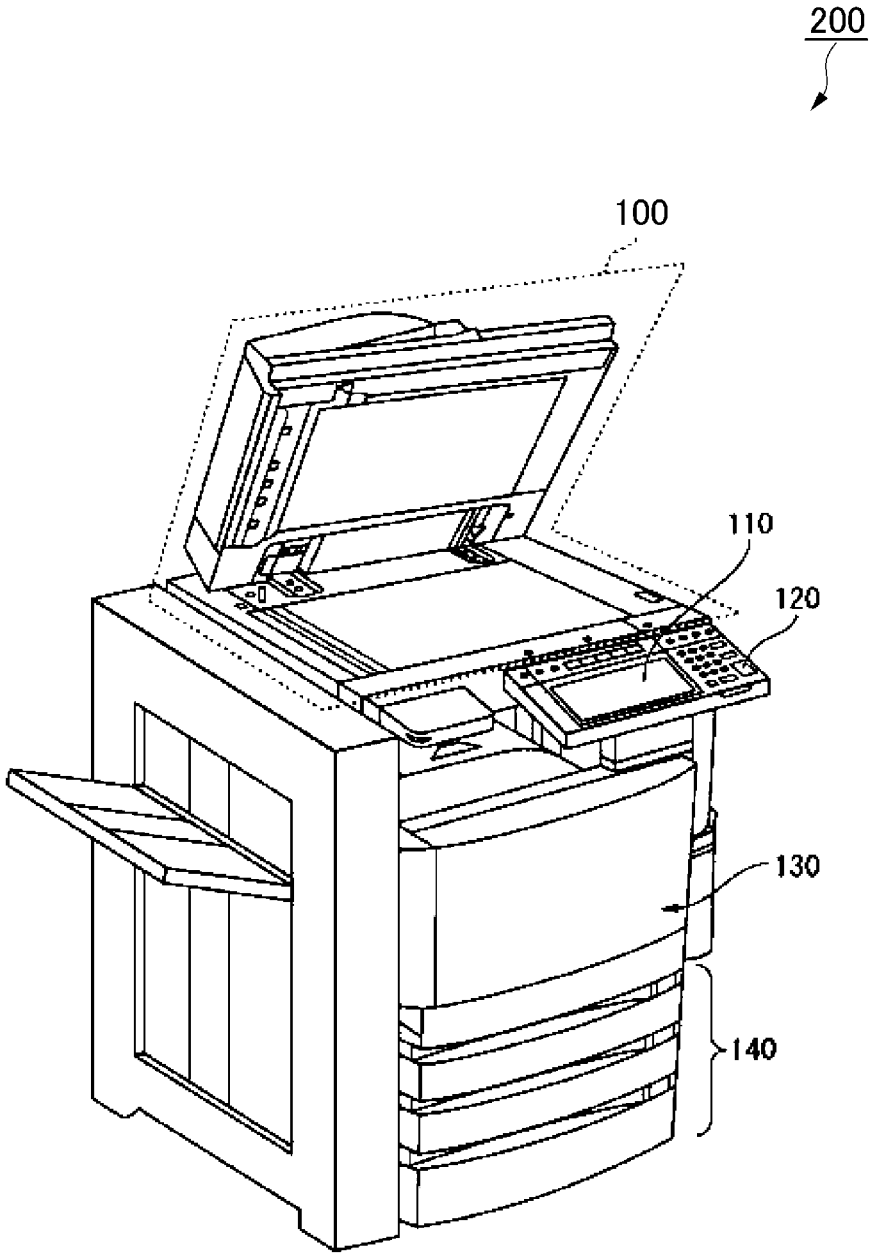
FIG. 9 is a diagram illustrating a configuration of an image forming apparatus provided with the sheet conveying device.

The sheet conveying device 100 and the sheet conveying device 100*a* may be used in an image forming apparatus. Specifically, the sheet conveying apparatus 100 and the sheet conveying apparatus 100*a* may be included in the image forming apparatus as illustrated in FIG. 9. FIG. 9 is a view illustrating a configuration of an image forming apparatus 200 provided with a sheet conveying device. In FIG. 9, the image forming apparatus 200 including the sheet conveying device 100 is illustrated as an example. The image forming apparatus 200 is a multi-function peripheral (MFP). The image forming apparatus 200 executes printing by the image forming process and the image fixing process. The image forming process is a process of forming an image on a sheet. The image fixing process is a process of fixing the image formed on the sheet. The image forming apparatus 200 executes the image forming process and the image fixing process based on image information read by the sheet conveying device 100.

The image forming apparatus 200 includes a display 110, a control panel 120, a printer unit 130, a sheet storage unit 140, and the sheet conveying device 100. The printer unit 130 of the image forming apparatus 200 is a device for fixing a toner image.

The display 110 is an image display device such as a liquid crystal display or an organic electro luminescence (EL) display. The display 110 displays various types of information regarding the image forming apparatus 200. The display 110 outputs a signal corresponding to an operation performed by the user to a central processing unit (CPU) of the image forming apparatus 200. The display 110 receives the operation of the user.

The control panel 120 has a plurality of buttons. The control panel 120 receives the operation of the user. The control panel 120 outputs a signal corresponding to the operation performed by the user to the CPU of the image forming apparatus 200. The display 110 and the control panel 120 may be configured as an integral touch panel.

The printer unit 130 executes an image forming process. In the image forming process, the printer unit 130 forms an image on a sheet fed from the sheet storage unit 140. The image formed by the printer unit 130 is based on image information generated by the sheet conveying device 100 or image information received via the communication path. The sheet storage unit 140 stores sheets used for image formation in the printer unit 130.

The CPU of the image forming apparatus 200 may realize a part of the functions of the control device 20 included in the sheet conveying device 100 and the control device 20*a* included in the sheet conveying device 100*a*. For example, when the predetermined condition is satisfied, the CPU of the image forming apparatus 200 may delay the determination timing of the presence or absence of the sheet placed on the placement tray 10 to the predetermined timing.

The sheet is not limited to a sheet from which an image is read, but may be one on which the image is recorded. That is, the sheet may be a sheet stored in the sheet storage unit 140.

According to at least one embodiment described above, the sheet conveying device includes the placement tray, the presence detection sensor, and the control unit. The placement tray places a sheet thereon. The presence detection sensor detects the presence or absence of a sheet on the placement tray. When the predetermined condition is satisfied, the control unit delays the determination timing of the presence or absence of the sheet placed on the placement tray to the predetermined timing. With this configuration, the determination timing of the presence or absence of the sheet based on the detection result of the presence detection sensor can be delayed. As such, the sheet conveying device determines the presence or absence of the sheet by considering the delay time of the return of the first end portion of the actuator of the placement tray. Accordingly, when the sheet on the placement tray ran out, a sufficient time until the presence detection sensor is turned OFF can be secured. For that reason, an erroneous determination can be suppressed without lowering efficiency. As a result, the occurrence of jamming can be prevented.

A part of the functions of the sheet conveying devices 100 and 100*a* and the image forming apparatus 200 in the embodiments described above may be realized by a computer. In this case, a program for realizing this function is recorded on a computer-readable recording medium. The program may be realized by causing a computer system to read and execute a program recorded in a recording medium having the program described above recorded thereon.

The "computer system" referred to herein includes an operating system and hardware such as peripheral equipment. The "computer-readable recording medium" means a portable medium, a storage device, and the like. The portable medium is a flexible disk, a magneto-optical disk, a ROM, a CD-ROM or the like. The storage device is a hard disk or the like embedded in a computer system. Furthermore, the "computer-readable recording medium" dynamically holds a program for a short time, like a communication line in the case of transmitting a program via a communication line. The communication line is a network such as the Internet, a telephone line or the like. The "computer-readable recording medium" may be a volatile memory within a computer system functioning as a server or a client. The volatile memory is one that holds a program for a certain period of time. The program may be one for realizing a part of the functions described above. The program may be one that can realize the functions described above in combination with a program already recorded in a computer system.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sheet conveying device, comprising:

a placement tray configured to hold a sheet thereon;

a presence detection sensor configured to detect a presence or absence of the sheet on the placement tray;

a control unit configured to delay a determination timing of the presence or absence of the sheet on the placement tray to a predetermined timing, when a predetermined condition is satisfied, the predetermined condition is a lifted amount of the placement tray becomes equal to or greater than a specified value or a predetermined number of sheets on the placement tray are fed;

a first next-sheet feeding sensor configured to detect a presence or absence of the sheet on a path along which the sheet is conveyed; and a second next-sheet feeding sensor installed on a downstream side of the first next-sheet feeding sensor and configured to detect the presence or absence of the sheet on the path along which the sheet is conveyed, wherein the predetermined timing is a timing when the second next-sheet feeding sensor detects the absence of the sheet, and the control unit determines the presence or absence of the sheet based on a detection result of the presence detection sensor obtained after the predetermined timing is reached.

2. The sheet conveying device according to claim 1, wherein the presence detection sensor has an end portion that protrudes onto the placement tray when the absence of the sheet is detected and the end portion does not protrude onto the placement tray when the presence of the sheet is detected.

3. The sheet conveying device according to claim 1, further comprising:

a registration roller for adjusting an output timing of the sheet installed on a downstream side of the first next-sheet feeding sensor;

the second next-sheet feeding sensor is installed between the next-sheet feeding sensor and the registration roller.

4. The sheet conveying device according to claim 1, comprising:

a first mode in which the determination timing of the presence or absence of the sheet on the placement tray is delayed to the predetermined timing, and a second mode in which a document exchange speed is prioritized, wherein the control unit is configured to switch between the first mode and the second mode.

5. A sheet conveying device, comprising:

a placement tray configured to hold a sheet thereon;

a presence detection sensor configured to detect a presence or absence of the sheet on the placement tray; and a control unit configured to delay a determination timing of the presence or absence of the sheet on the placement tray to a predetermined timing, when a condition indicating that a lifted amount of the placement tray becomes equal to or greater than a specified value is satisfied, wherein the control unit calculates the lifted amount of the placement tray based on the time until the placement tray is lifted from a lower limit position to an upper limit position and the time from the start of the lifting of the placement tray to the stop of the lifting of the placement tray during feeding of the sheet.

6. The sheet conveying device according to claim 5, further comprising:

a registration roller for adjusting an output timing of the sheet installed on a downstream side of the first next-sheet feeding sensor;

a second next-sheet feeding sensor is installed between the next-sheet feeding sensor and the registration roller.

7. The sheet conveying device according to claim 5, comprising:

a first mode in which the determination timing of the presence or absence of the sheet on the placement tray is delayed to the predetermined timing, and a second mode in which a document exchange speed is prioritized, wherein the control unit is configured to switch between the first mode and the second mode.

8. An image forming apparatus, comprising:

a placement tray configured to hold a sheet thereon;

a presence detection sensor configured to detect a presence or absence of the sheet on the placement tray;

a control unit configured to delay a determination timing of the presence or absence of the sheet on the placement tray to a predetermined timing, when a predetermined condition is satisfied, the predetermined condition is a lifted amount of the placement tray becomes equal to or greater than a specified value or a predetermined number of sheets on the placement tray are fed;

a first next-sheet feeding sensor configured to detect a presence or absence of the sheet on a path along which the sheet is conveyed;

a second next-sheet feeding sensor installed on a downstream side of the first next-sheet feeding sensor and configured to detect the presence or absence of the sheet on the path along which the sheet is conveyed, wherein the predetermined timing is a timing when the second next-sheet feeding sensor detects the absence of the sheet, and the control unit determines the presence or absence of the sheet based on a detection result of the presence detection sensor obtained after the predetermined timing is reached;

a storage unit configured to store a second sheet; and a printer unit configured to form an image on the second sheet fed from the storage unit based on image information generated from the first sheet.

9. The image forming apparatus according to claim 8, wherein the presence detection sensor has an end portion that protrudes onto the placement tray when the absence of the sheet is detected and the end portion does not protrude onto the placement tray when the presence of the sheet is detected.

10. The image forming apparatus according to claim 8, comprising:

a first mode in which the determination timing of the presence or absence of the sheet on the placement tray is delayed to the predetermined timing, and a second mode in which a document exchange speed is prioritized, wherein the control unit is configured to switch between the first mode and the second mode.

11. An image forming apparatus, comprising:

a placement tray configured to hold a sheet thereon;

a presence detection sensor configured to detect a presence or absence of the sheet on the placement tray;

a control unit configured to delay a determination timing of the presence or absence of the sheet on the placement tray to a predetermined timing, when a condition indicating that a lifted amount of the placement tray becomes equal to or greater than a specified value is satisfied, wherein the control unit calculates the lifted amount of the placement tray based on the time until the placement tray is lifted from a lower limit position to an upper limit position and the time from the start of the lifting of the placement tray to the stop of the lifting of the placement tray during feeding of the sheet;

a storage unit configured to store a second sheet; and a printer unit configured to form an image on the second sheet fed from the storage unit based on image information generated from the first sheet.

12. The image forming apparatus according to claim 11, comprising:

a first mode in which the determination timing of the presence or absence of the sheet on the placement tray is delayed to the predetermined timing, and a second mode in which a document exchange speed is prioritized, wherein the control unit is configured to switch between the first mode and the second mode.

* * * * *